US007638785B2

(12) United States Patent
Yanagita et al.

(10) Patent No.: US 7,638,785 B2
(45) Date of Patent: Dec. 29, 2009

(54) READING SYSTEM FOR RADIATION IMAGE CONVERSION PANEL AND RADIATION IMAGE CONVERSION PANEL

(75) Inventors: Takafumi Yanagita, Tokyo (JP); Tadashi Arimoto, Tokyo (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 12/017,977

(22) Filed: Jan. 22, 2008

(65) Prior Publication Data

US 2008/0251741 A1 Oct. 16, 2008

(30) Foreign Application Priority Data

Jan. 25, 2007 (JP) ..... 2007-014805

(51) Int. Cl.
*G21K 4/00* (2006.01)

(52) U.S. Cl. ..... 250/584

(58) Field of Classification Search ..... 250/584
See application file for complete search history.

(56) References Cited

U.S. PATENT DOCUMENTS

| | | | | |
|---|---|---|---|---|
| 3,859,527 | A | 1/1975 | Luckey | |
| 4,563,580 | A | 1/1986 | Ishizuka | |
| 7,087,918 | B2 * | 8/2006 | Hall | 250/588 |
| 7,170,077 | B2 * | 1/2007 | Lamotte et al. | 250/580 |
| 2004/0016886 | A1 * | 1/2004 | Ringermacher et al. | 250/370.11 |
| 2005/0051732 | A1 * | 3/2005 | Du Plessis | 250/394 |
| 2005/0051735 | A1 | 3/2005 | Tazaki | |
| 2007/0215818 | A1 * | 9/2007 | Bermel et al. | 250/484.4 |

FOREIGN PATENT DOCUMENTS

| | | |
|---|---|---|
| JP | 55012144 | 1/1980 |
| JP | 2058000 | 2/1990 |
| JP | 2005091222 | 4/2005 |
| JP | 2006125854 | 5/2006 |

* cited by examiner

*Primary Examiner*—David P Porta
*Assistant Examiner*—Djura Malevic
(74) *Attorney, Agent, or Firm*—Lucas & Mercanti, LLP

(57) ABSTRACT

A reading system for reading information recorded in a radiation image conversion panel containing a flexible substrate having thereon a phosphor layer containing a columnar crystal phosphor, wherein the reading system has a transport section to transport the radiation image conversion panel with curvature when the radiation image conversion panel is transported in the reading system, provided that the radiation image conversion panel has a curvature radius of from 50 to 500 mm during transportation by the transport section in the reading system.

14 Claims, 2 Drawing Sheets

READING SYSTEM FOR RADIATION IMAGE CONVERSION PANEL AND RADIATION IMAGE CONVERSION PANEL

This application is based on Japanese Patent Application No. 2007-014805 filed on Jan. 25, 2007 with Japan Patent Office, the entire content of which is hereby incorporated by reference.

TECHNICAL FIELD

The present invention relates to a reading system for a radiation image conversion panel, and in more detail to a reading system for a radiation image conversion panel and a radiation image conversion panel.

BACKGROUND

Radiation images such as X-ray images have been widely employed in the medical field for diagnosis of diseases. As a method of obtaining the X-ray images, the so called radiographic method has been widely utilized, wherein a phosphor layer (or a fluorescent screen) is exposed to X-rays, having passed through a medical patient, that is a subject, to emit visible light, which exposes a silver halide photosensitive material (hereinafter also referred to simply as a sensitive material) in the same manner as in usual picture-taking, and thereafter a visible silver image is produced via development processing.

Recently, however, instead of an image forming method using a sensitive material incorporating a silver halide, a new method for directly capturing images from a phosphor layer has been proposed.

This method includes a method of imaging via fluorescence detection, wherein radioactive rays, having passed through a subject, is absorbed in a phosphor, followed by stimulating this phosphor, for example, via light or heat energy so as to emit radiation energy, accumulated in the phosphor via the above absorption, as fluorescence.

Specifically, a radiation image conversion method using a stimulable phosphor (hereinafter also referred to simply as a phosphor) is known (for example, refer to Patent Documents 1 and 2).

This method is one which employs a radiation image conversion panel containing a stimulable phosphor as follows: the stimulable phosphor layer of this radiation image conversion panel is irradiated with radioactive rays having been passed through a subject, resulting in accumulation of radiation energy corresponding to the radiation transmittance density of each portion of the subject; thereafter, the stimulable phosphor is stimulated via an electromagnetic wave (or an exciting light) such as visible or infrared light in chronological order to emit the radiation energy, having been accumulated in the stimulable phosphor, as stimulated emission light; and signals based on the intensity of the emission light are converted into electrical signals, for example, via photoelectric conversion, whereby the electrical signals are reproduced as a visible image on a recording material such as a silver halide photosensitive material or a display device such as a CRT.

The above reproduction method of a radiation image exhibits the advantage of obtaining a radiation image showing great detail information at a far lower exposure dose, compared to conventional radiographic methods employing a radiographic film in combination with an intensifying screen.

Since a radiation image conversion panel employing the stimulable phosphor accumulates radiation image Information, followed by emitting the accumulated energy via scanning exciting light, another accumulation of a new radiation image may be conducted after the scanning, resulting in repetitive use of the conversion panel Namely, while one radiographic film is consumed for each image in a conventional radiographic method, a radiation image conversion panel may be repeatedly utilized via this radiation image conversion method, resulting in advantages in resource conservation and economic efficiency.

Further, in recent years, a radiation image conversion panel exhibiting higher sharpness has been demanded. As a method of enhancing sharpness, various attempts to enhance sensitivity and sharpness have been investigated, for example, by controlling the form itself of the formed stimulable phosphor.

As one of these attempts, a method employing a radiation image conversion panel incorporating a stimulable phosphor layer, structured of elongated columnar crystals, has been proposed, wherein the elongated columnar crystals are formed on a substrate via a vapor growth method (also called a vapor deposition method) so that the crystal axis of the columnar crystals is inclined at a predetermined angle relative to the normal direction of the substrate (refer to Patent Document 3).

Recently, a radiation image conversion panel incorporating a stimulable phosphor has been proposed, wherein an alkali halide such as CsBr is utilized as a phosphor host and Eu is utilized as an activator, resulting in high X-ray conversion efficiency, which has not been conventionally realized.

However, in radiation image conversion panels used under a variety of conditions, adhesion between the substrate and the phosphor layer is one of the critical characteristics. To enhance the adhesion, there has been disclosed a method of placing a resinous sublayer containing a cross-linking agent between the substrate and the phosphor layer (Patent Documents 4-6). In cases in which only a resinous sublayer is placed, when forming the stimulable phosphor layer on the resinous sublayer of high surface roughness via the vapor growth method, poor adhesion to the substrate occurs and accordingly the crystal structure of the phosphor layer is unevenly formed, resulting in a tendency to cause varying sharpness and uneven graininess in imaging via a radiation image conversion panel. Further, temporal stability of the characteristics is likely to decrease because the film thickness of the resinous sublayer is too high.

Further, there may occur defects such as breaking of a radiation image conversion panel, peeling off the phosphor and nonuniformity of image when a curvature radius of a radiation image conversion panel is very small in case that the radiation image conversion panel put in a transportable container is irradiated with X rays and then it is subjected to be read with a reading system in which the radiation image conversion panel is bent in the reading system for reading information recorded in it.

(Patent Document 1) U.S. Pat. No. 3,859,527

(Patent Document 2) Japanese Patent Publication Open to Public Inspection (hereinafter referred to as JP-A) No. 55-12144

(Patent Document 3) JP-A No. 2-58000

(Patent Document 4) U.S. Pat. No. 4,563,580

(Patent Document 5) JP-A No. 2005-91222

(Patent Document 6) JP-A No. 2006-125854

SUMMARY

An object of the present invention is to provide a reading system for a radiation image conversion panel and a radiation image conversion panel having the following features. The radiation image conversion panel of the present invention has minimized defects such as breaking of a radiation image conversion panel, peeling off the phosphor and nonuniformity of image when it is put in a transportable container and is irradiated with X rays and then it is subjected to be read with a reading system in which the radiation image conversion panel is bent in the reading system for reading information recorded in it. When the radiation image conversion panel can be bent without being broken, the size of the whole system can be reduced.

An object of the present invention can be achieved by the following embodiments.

1. One of the embodiments of the present invention is a reading system for reading information recorded in a radiation image conversion panel comprising a flexible substrate having thereon a phosphor layer comprising a columnar crystal phosphor, wherein the reading system has a transport section to transport the radiation image conversion panel with curvature when the radiation image conversion panel is transported in the reading system, provided that the radiation image conversion panel has a curvature radius of from 50 to 500 mm during transportation by the transport section in the reading system.

2. Another embodiment of the present invention is a reading system of the above-described item 1, wherein the curvature radius of the radiation image conversion panel during transportation by the transport t section in the reading system is from 55 to 200 mm.

3. Another embodiment of the present invention is a radiation image conversion panel comprising a flexible substrate having thereon a crystal layer comprising a columnar crystal phosphor used for the reading system of the above-described items 1 or 2.

4. Another embodiment of the present invention is a radiation image conversion panel of the above-described item 3, wherein the flexible substrate is an organic resin film.

5. Another embodiment of the present invention is a radiation image conversion panel of the above-described items 3 or 4, wherein the flexible substrate is made of one selected from the group consisting of polyethylene terephthalate, polyethylene naphthalate, polyethylene sulfide, polyimide, polyamide and aramid.

6. Another embodiment of the present invention is a radiation image conversion panel of any one of the above-described items 3-5, wherein the flexible substrate has a sublayer between the flexible substrate and the phosphor layer, the sublayer comprising an organic resin and having a thickness of 0.1 to 10 μm.

7. Another embodiment of the present invention is a radiation image conversion panel of any one of the above-described items 3-6, wherein the flexible substrate has a thickness of 0.5 to 5 mm.

8. Another embodiment of the present invention is a radiation image conversion panel of any one of the above-described items 3-7, wherein the columnar crystal phosphor is a stimulable phosphor.

9. Another embodiment of the present invention is a radiation image conversion panel of the above-described item 8, wherein the stimulable phosphor comprises CsBr as a matrix component.

10. Another embodiment of the present invention is an X ray photography apparatus comprising:

a transportable container to contain the radiation image conversion panel of any one of the above-described items 3-9 therein;

an irradiation section to irradiate the radiation image conversion panel contained in the transportable container with X rays; and a reading system to read information recorded in the radiation image conversion panel.

DESCRIPTION OF THE PREFERRED EMBODIMENTS

Figure 1:
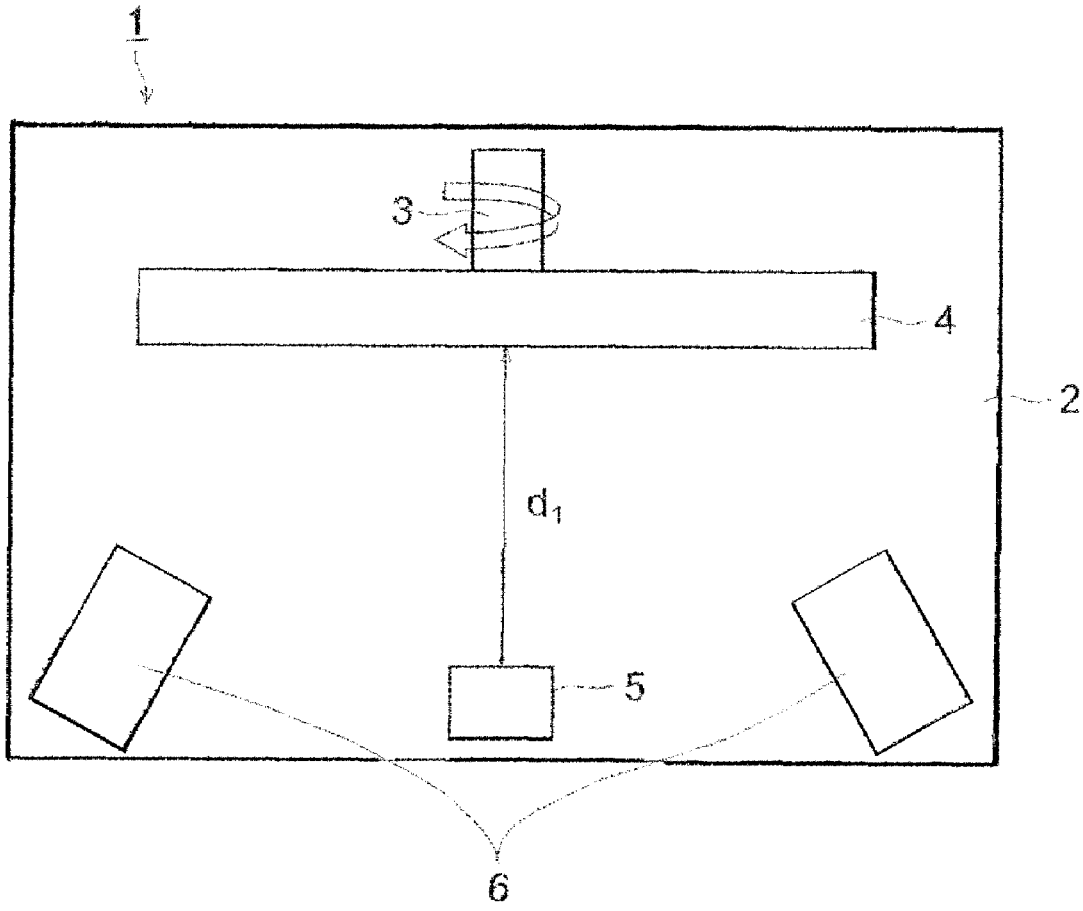
FIG. 1 is a schematic view showing one example of a deposition apparatus utilized to form the stimulable phosphor layer of the present invention.

The present invention will now be detailed.

[Reading System for a Radiation Image Conversion Panel]

A reading system for a radiation image conversion panel of the present invention will be explained. Here, in particular the reading method employing a stimulable phosphor is described. Firstly, a radiation image conversion panel is irradiated with radiation such as X rays which are passed though a subject Latent images are formed in the radiation image conversion panel in proportion to an amount of radiation entered in the panel. When the plate having the latent images in it is subjected to a reading system, the plate produces emission of light by irradiating with a stimulating laser. The intensity of emitted light is proportional to the amount of latent images. The emitted light is amplified with a photomultiplier and is changed into electronic signals.

[Flexible Substrate]

A flexible substrate used in a radiation image conversion panel of the present invention will be explained. Examples of flexible substrates of the present invention are: polyethylene terephthalate (PET), polyethylene naphthalate (PEN), polyethylene sulfide (PES), polyimide (PI), polyamide and aramid.

(Sublayer)

According to the present invention, a sublayer is preferably placed between the organic resin film and the stimulable phosphor layer.

Resins employed for the sublayer are preferably organic resins but are not specifically limited, including, for example, polyvinyl alcohol, polyvinyl butyral, polyvinyl formal, polycarbonate, polyester resins, polyethylene terephthalate, polyethylene, nylon, (meth)acrylic acid or (meth)acrylate, vinyl esters, vinyl ketones, styrenes, diolefins, (meth)acrylamides, vinyl chlorides, vinyl vinylidenes, cellulose derivatives such as nitrocellulose, acetyl cellulose, or diacetyl cellulose, silicon resins, polyurethane resins, polyamide resins, various synthetic rubber resins, phenol resins, epoxy resins, urea resins, melamine resins, and phenoxy resins. Of these, hydrophobic resins such as polyester resins or polyurethane resins are preferable from the viewpoint of adhesion between the substrate and the stimulable phosphor layer and anti-corrosion properties of the substrate.

The film thickness of the sublayer of the present invention is 0.1-10 μm, preferably 1-5 μm. When the film thickness of the sublayer is less than 0.1 μm, adhesion force between the substrate and the stimulable phosphor layer tends to decrease in some cases, and when being more than 10 μm, temporal stability of quality such as sharpness tends to be degraded.

Measurement devices via a surface roughness measurement method known in the art such as a stylus method or a laser gauge interferometry may be utilized.

The sublayer of the present invention may contain a cross-linking agent to enhance its film strength in addition to a resin. Usable cross-linking agents are not specifically limited, including, for example, multifunctional isocyanates and derivatives thereof, melamines and derivatives thereof, amino resins and derivatives thereof, but multifunctional isocyanate compounds are preferable. Examples of the multifunctional isocyanate compounds include, for example, CORONATE HX and CORONATE 3041 (produced by Nippon Polyurethane Industry Co., Ltd.).

The amount used of the cross-linking agent varies depending on the characteristics of the targeted radiation image conversion panel, the types of materials for use in the stimulable phosphor layer and the substrate, and the types of resins for use in the sublayer. In consideration of maintaining adhesion force between the stimulable phosphor layer and the substrate, a used amount of at most 50% by weight based on the amount of the sublayer is preferable, but 5-30% by weight is more preferable. In cases of less than 5% by weight, a cross-linking density tends to be too low, resulting in inadequate heat resistance and strength. In cases of more than 30% by weight, a cross-linking density tends to be too high, resulting in poor toughness with the sublayer (namely being fragile), which causes the sublayer to be cracked.

In the present invention, before coating the stimulable phosphor layer on the sublayer, having been coated on the substrate, heat treatment is carried out at 40-150° C. for 1-100 hours to complete reaction of the resin with the cross-linking agent in the sublayer.

The sublayer is produced by coating a sublayer coating solution on the substrate, followed by being dried. Coating methods are not specifically limited Coating is conducted employing coaters known in the art such as a doctor blade coater, roll coater, knife coater, extrusion coater, as well as a spin coater.

(Stimulable Phosphor)

The stimulable phosphor of the present invention will now be described. The phosphor of the present invention is preferably a stimulable phosphor, but the stimulable phosphor represented by Formula (1) is preferable.

$$M^1X.aM^2X'_2:eA,A'' \qquad \text{Formula (1)}$$

wherein $M^1$ represents at least one kind of alkali metallic atom selected from atoms including Li, Na, K, Rb, and Cs; $M^2$ represents at least one kind of divalent metallic atom selected from atoms including Be, Mg, Ca, Sr, Ba, Zn, Cd, Cu, and Ni; X and X' represent at least one kind of halogen atom selected from atoms including F, Cl, Br, and I; A and A" represent at least one kind of rare earth atom selected from atoms including Eu, Tb, In, Ce, Tm, Dy, Pr, Ho, Nd, Yb, Er, Gd, Lu, Sm, and Y; and a and e represent a numeric value in the range expressed by equations $0 \leqq a < 0.5$ and $o < e \leqq 0.2$, respectively.

In the stimulable phosphor represented by Formula (1), $M^1$ represents at least one kind of alkali metallic atom selected from atoms including Na, K, Rb, and Cs. Of these, at least one kind of alkali metallic atom selected from atoms including Rb and Cs is preferable, but Cs is more preferable.

$M^2$ represents at least one kind of divalent metallic atom selected from atoms including Be, Mg, Ca, Sr, Ba, Zn, Cd, Cu, and Ni. Of these, divalent metallic atoms selected from atoms including Be, Mg, Ca, Sr, and Ba are preferably utilized.

A represents at least one kind of metallic atom selected from atoms including Eu, Tb, In, Ga, Ce, Tm, Dy, Pr, Ho, Nd, Yb, Er, Gd, Lu, Sm, Y, Tl, Na, Ag, Cu, and Mg.

From the viewpoint of enhancing stimulated emission luminance, at least one kind of halogen atom selected from F, Cl, and Br is preferably utilized, although X, X', and X" represent at least one kind of halogen atom selected from atoms including F, Cl, Br, and I. However, at least one kind of halogen atom selected from Br and I is more preferable.

The stimulable phosphor represented by Formula (1) may be produced, for example, via a production method described below.

As raw materials of the phosphor, (a) at least one kind of or at least two kinds of compounds are utilized, being selected from NaF, NaCl, NaBr, NaI, KF, KCl, KBr, KI, RbF, RbCl, RbBr, RbI, CsF, CsCl, CsBr, and CsI.

Further, (b) at least one kind of or at least two kinds of compounds are utilized, being selected from $MgF_2$, $MgCl_2$, $MgBr_2$, $MgI_2$, $CaF_2$, $CaCl_2$, $CaBr_2$, $CaI_2$, $SrF_2$, $SrCl_2$, $SrBr_2$, $BaI_2$, $BaF_2$, $BaCl_2$, $BaBr_2$, $BaBr_2.2H_2O$, $BaI_2$, $ZnF_2$, $ZnCl_2$, $ZnBr_2$, $ZnI_2$, $CdF_2$, $CdCl_2$, $CdBr_2$, $CdI_2$, $CuF_2$, $CuCl_2$, $CuBr_2$, $CuI_2$, $NiF_2$, $NiCl_2$, $NiBr_2$, and $NiI_2$.

Still further, (c) compounds represented by Formula (1) are utilized, wherein the compounds contain metallic atoms selected from atoms including Eu, Tb, In, Cs, Ce, Tm, Dy, Pr, Ho, Nd, Yb, Er, Gd, Lu, Sm, Y, Tl, Na, Ag, Cu, and Mg.

In the compounds represented by Formula (1), the following relationships are satisfied: $0 \leqq a < 0.5$ for a preferably $0 \leqq a < 0.01$; and $0 < e \leqq 0.2$ for e, preferably $0 < e \leqq 0.1$.

The phosphor raw materials (a) to (c) are measured such that the mixing composition is fallen within the above-described range, and then they are mixed in a mortar, a ball mill or a mixer mill.

Next, the obtained phosphor raw material mixture is loaded in a heat resisting container such as a quartz crucible or an alumina crucible and then it is burned in an electric furnace.

The burning temperature is appropriate in the range of 300 to 1000° C. The burning time varies depending on the amount of the loaded raw material mixture or on the burning temperature. The burning time would be appropriate to be 0.5 to 6 hours.

Preferable examples of the atmospheres of the burning are: a nitrogen gas containing a small amount of hydrogen gas; a weak reductive atmosphere such as a carbon dioxide containing a small amount of carbon oxide; a neutral atmosphere such as a nitrogen gas or an argon gas; and a weak oxidizing atmosphere such as a nitrogen gas containing a small mount of oxygen gas.

It is preferable to repeat the same procedure against the once obtained burned product. That is, after finishing the first burning under the above-described conditions, the obtained burned product is taken out of the electric furnace and then is pulverized. The pulverized first burned product is loaded again in a heat resisting container followed by put in an electric furnace so as to burn again under the same condition as the first burning. The repeated burning is preferable to obtain a phosphor having a high emission luminance.

When the burned product is cooled to a room temperature from the burned temperature, the cooling can be done in an air after taking the burned product out of the electric furnace to obtain the intended phosphor. The cooling may be done in a weak reductive atmosphere or in a neutral atmosphere used for the burning condition.

The emission luminance of the obtained phosphor after irradiated with a stimulable light can be further increased by transferring the burned product from a heating section to a cooling section in the electric furnace then rapidly cooled in a weak reductive atmosphere, in a neutral atmosphere or in a weak oxidizing atmosphere.

Further, the stimulable phosphor layer of the present invention is preferably formed via a vapor growth method.

As the vapor growth method used to prepare the stimulable phosphor, a deposition method, sputtering method, CVD method, and ion plating method may be utilized.

According to the present invention, the following methods may be exemplified.

In the deposition method firstly exemplified, initially, a substrate is placed in a deposition apparatus, followed by being exhausted to a vacuum degree of about $1.333\times10^{-4}$ Pa. Subsequently, at least one of the above stimulable phosphors is vaporized by heating via a resistance heating method or electron beam method to allow the stimulable phosphor layer to grow on the substrate at the desired thickness. Consequently, a stimulable phosphor layer containing no binder is formed, but in the above deposition process, it is also possible to form the stimulable phosphor layer in plural stages.

Further, in the deposition process, it is possible to synthesize the targeted stimulable phosphor on the substrate and to form a stimulable phosphor layer thereon simultaneously via a co-deposition method employing a plurality of resistance heaters or electron beams.

After terminating the deposition, it is preferable to produce the radiation image conversion panel of the present invention so that a protective layer is placed on the side opposite to the substrate of the stimulable phosphor layer, as appropriate. Incidentally, a process of placing the substrate may follow formation of the stimulable phosphor layer on a protective layer.

Further, in the deposition method, a substance (namely a substrate, protective layer, or intermediate layer) to be deposited may be cooled or heated during deposition, as appropriate.

Still further, the stimulable phosphor layer may be heat-treated after deposition. Also, in the deposition method, a reactive deposition method may be employed, if applicable, wherein deposition is carried out by introducing gas such as $O_2$ or $H_2$.

In the sputtering method exemplified as a second method, similarly to the deposition method, a substrate incorporating a protective layer or intermediate layer is placed in a sputtering apparatus, followed by being temporarily exhausted to a vacuum degree of about $1.333\times10^{-4}$ Pa. Subsequently, an inert gas such as Ar or Ne for use in sputtering is introduced into the sputtering apparatus to allow the gas pressure to be about $1.333\times10^{-1}$ Pa. Thereafter, sputtering is carried out using the stimulable phosphor as the target to allow a stimulable phosphor layer to grow on the substrate at the desired thickness.

In the sputtering process, similarly to the deposition method, various kinds of applied treatment may be employed.

A third method is a CVD method, and a fourth one is an ion plating method.

Further, in the vapor growth method, it is preferable that a growth rate of the stimulable phosphor layer be 0.05-300 μm/min. A growth rate of less that 0.05 μm/mm unfavorably results in low productivity of the radiation image conversion panel of the present invention. Also, a growth rate of more than 300 μm/min unfavorably results in the difficulty of controlling the growth rate.

In cases obtaining a radiation image conversion panel via the deposition method or sputtering method, the radiation image conversion panel, which is preferable in terms of sensitivity and resolution, may be favorably obtained since a filling density of the stimulable phosphor is enhanced due to the absence of a binder.

The film thickness of the stimulable phosphor layer varies depending on the intended use of the radiation image conversion panel and the type of the stimulable phosphor. However, from the viewpoint of producing effects of the present invention, the thickness is preferably 50-1000 μm, more preferably 100-600 μm, still more preferably 100-500 μm.

In preparation of the stimulable phosphor layer via the vapor growth method, the temperature of the substrate is preferably set at 100° C. at least to form the stimulable phosphor layer thereon, but more preferably set at 150° C. at least, most preferably at 150-400° C.

The stimulable phosphor layer in the radiation image conversion panel of the present invention is preferably made with a gas phase growing method employing the stimulable phosphor represented by Formula (1) on a substrate. It is preferable that the stimulable phosphor forms a columnar crystal during formation of the layer.

To form a stimulable phosphor layer structured of columnar crystals, the compounds (namely the stimulable phosphors) represented by Formula (1) are utilized. Of these, CsBr phosphors represented by Formula (2) shown below are most preferably utilized.

In the present invention, it is preferable that a columnar crystal contains a stimulable phosphor represented by Formula (2).

CsX:A

Formula (2)

wherein X represents Br or I, and A represents Eu, In, Tb, Tl, or Ce.

In a method of forming a phosphor layer on the substrate via a vapor deposition method, a stimulable phosphor layer composed of independent elongated columnar crystals may be produced by supplying vapor or a raw material of the stimulable phosphor via a vapor growth (namely deposition) method such as a deposition method. In these cases, the shortest distance between the substrate and a crucible used is preferably set commonly to 10-60 cm so as to correspond to the average range of the stimulable phosphor.

The stimulable phosphor serving as a vaporization source is placed in the crucible after being homogeneously dissolved or after being molded with a press or hot press. At this time, it is preferable to carry out degassing treatment. To vaporize the stimulable phosphor from the vaporization source, a scanning method using electron beams, discharged from an electron gun, is employed, but deposition may be conducted via any other appropriate methods.

Further, it is not necessary that the vaporization source is the stimulable phosphor, but a mixture with the raw material of the stimulable phosphor may be utilized.

Still further, an activator may be doped in a phosphor host afterward. For example, after deposition of only CsBr serving as a host, Ti serving as an activator may be doped for the following reasons: since crystals each are independent, doping may be adequately carried out even when the film thickness is large; and since the crystals tend not to grow, MTF may not decrease.

White pigments may reflect stimulated emission light. Examples of the white pigments include $TiO_2$ (anatase or rutile type), MgO, $PbCO_3.Pb(OH)_2$, $BaSO_4$, $Al_2O_3$, M(II)FX (herein, M(II) is at least one of Ba, Sr, and Ca; and X is at least one of Cl and Br), $CaCO_3$, ZnO, $Sb_2O_3$, $SiO_2$, $ZrO_2$, lithopone ($BaSO_4$.ZnS), magnesium silicate, basic silicosulfate, basic lead phosphate, aluminum silicate. Since these white pigments exhibit excellent opacifying properties and a high refractive index, light may be reflected or refracted. Therefore, stimulated emission light may be readily scattered, resulting in the markedly enhanced sensitivity of a radiation image conversion panel obtained.

Further, as substances featuring high optical absorption, for example, carbon black, chromium oxide, nickel oxide, iron oxide, and blue colorants are utilized. Of these, carbon black may also absorb stimulated emission light.

Further, as colorants, either organic or inorganic colorants are applicable. Examples of organic colorants include Zabon First Blue 3G (produced by Hoechst AG), Estrol Bril Blue N-3RL (produced by Sumitomo Kagaku Co., Ltd.), D & C Blue No. 1 (produced by National Aniline Co.), Spirit Blue (produced by Hodogaya Kagaku Co., Ltd.), Oil Blue No. 603 (Produced by Orient Chemical Industries, Ltd.), Kiton Blue A (produced by Ciba Geigy Co.), Eisen Catilon Blue GLH (produced by Hodogaya Kagaku Co., Ltd.), Lake Blue AFH (produced by Kyowa Sangyo Co., Ltd.), Primocyanine 6GX (produced by Inahata Sangyo Co., Ltd.) Brilacid Green 6BH (produced by Hodogaya Kagaku Co, Ltd.), and Cyan Blue BNRCS (Produced by Toyo Ink Co., Ltd.), and Lyonoyl Blue SL (Produced by Toyo Ink Co., Ltd.). There are also exemplified organic metal complex colorants such as Color Index Nos. 24411, 23160, 74180, 74200, 22800, 23154, 23155, 24401, 14830, 15050, 15760, 15707, 17941, 74220, 13425, 13361, 13420, 11836, 74140, 74380, 74350, and 74460. Examples of inorganic colorants include ultramarine blue, cobalt blue, celurean blue, chromium oxide and $TiO_2$—ZnO—Co—NiO based pigments.

Incidentally, a deposition apparatus, as shown in FIG. 1, is typically utilized to form the stimulable phosphor layer via a vapor growth method.

In FIG. 1, symbol 1 designates a deposition apparatus; symbol 2 designates a vacuum chamber; symbol 3 designates a support rotation mechanism (a support rotation function); symbol 4 designates a support; symbol 5 designates a vaporization source; and symbol 6 designates a support surface temperature-controlling heater. Symbol $d_1$ represents the distance between the support 4 and the vaporization source.

Figure 2:
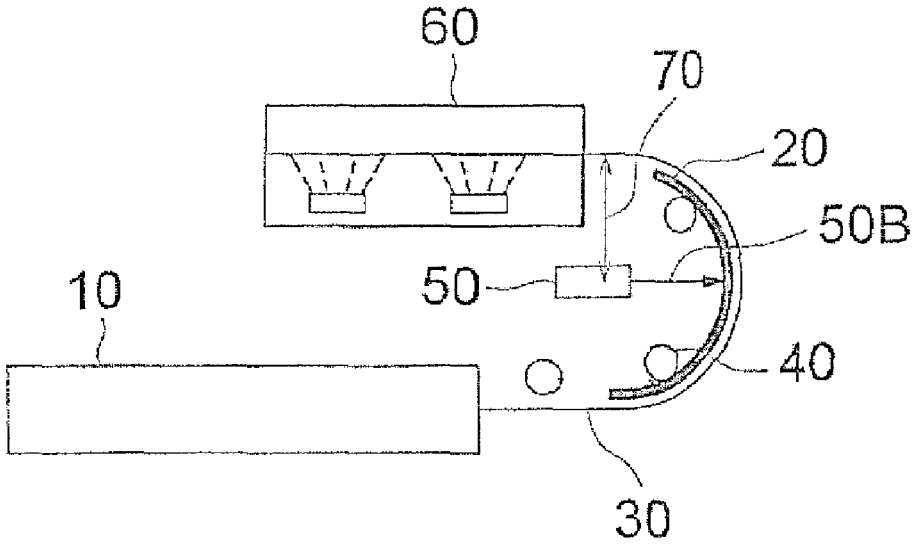
FIG. 2 is a schematic view showing one example of a reading system of the present invention in which a radiation image conversion panel is transported.

In FIG. 2, a radiation image conversion panel 20 contained in a cassette 10 is transported by the aid of a transportation guide 30 and a plurality of transportation rollers 40. The transportation guide 30 has a curvature radius 70 that makes the radiation image conversion panel 20 curved while it is transported. A laser light **50*b* for reading is emitted from a laser emitting device 50 and is irradiated on the surface of the radiation image conversion panel 20 to read the information stored in the panel 20. After being read, the information in the radiation image conversion panel is erased by an erasing device 60**.

Figure 3:
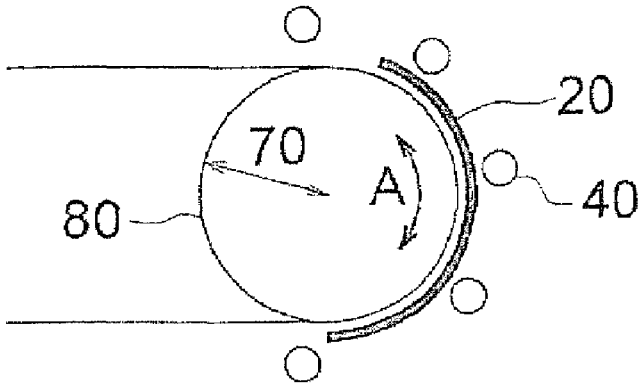
FIG. 3 is a schematic view showing one example of a device used for evaluation of a radiation image conversion panel.

In FIG. 3, a radiation image conversion panel 20 is wound on a column 80 having a curvature radius 70. The radiation image conversion panel 20 is transported in both directions of A by the aid of a plurality of transportation rollers 40 and the column 80.

(Protective Layer)

Further, the stimulable phosphor layer of the present invention may incorporate a protective layer.

A protective layer may be formed by directly coating a protective layer-coating solution on the stimulable phosphor layer, or a protective layer, having been separately formed, may be allowed to adhere to the stimulable phosphor layer. Alternatively, the stimulable phosphor layer may be formed on a separately formed protective layer. As materials used for the protective layer, commonly-used protective layer materials are employed, including cellulose acetate, nitrocellulose, polymethyl methacrylate, polyvinyl butyral, polyvinyl formal, polycarbonate, polyester, polyethylene terephthalate, polyethylene, polyvinilidene chloride, nylon, polytetrafluoroethylene, polytrifluoromonochloroethylene, tetrafluoroethylene-hexafluoropropylene copolymer, vinylidene chloride-vinyl chloride copolymer, and vinlylidene chloride acrylonitrile copolymer. There may also be employed a transparent glass substrate as the protective layer. Further, the protective layer may be formed by laminating an inorganic material such as SiC, $SiO_2$, SiN, or $Al_2O_3$ via such a method as deposition or sputtering. It is preferable that the layer thickness of the protective layer be commonly from 0.1-2000 μm approximately.

In the present invention, the beam diameter of a laser used to irradiate the stimulable phosphor layer is preferably at most 100 μm, more preferably at most 80 μm.

Examples of the laser include He—Ne laser, He—Cd laser, Ar ion laser, Kr ion laser, $N_2$ laser, YAG laser, other second harmonics, ruby laser, semiconductor lasers, various dye lasers, and metal vapor lasers such as copper vapor laser. A continuous oscillation laser such as He—Ne laser or Ar ion laser is commonly desirable, but a pulse oscillation laser is also usable if the scanning time per pixel of the panel is synchronized with a pulse time. Further, in a separation method employing delayed emission, as disclosed in JP-A No. 59-22046, modulation employing a pulse oscillation laser is preferable to one employing a continuous oscillation laser.

Of the various types of laser light sources, a semiconductor laser, which is compact and inexpensive, as well as requiring no modulator, is specifically preferable.

EXAMPLES

The present invention will now be detailed with reference to examples, but the present invention is by no means limited thereto.

Example 1

Preparation of Radiation Image Conversion Panel 1-16

On a surface of a polyethylene naphthalate (PEN) substrate having a thickness of 0.5 mm and an average surface roughness of 0.01 am was coated a solution of a polyester resin (Bayron made by Toyobo Co. Ltd., Tg: 60° C.) dissolved in a 1:1 mixed solvent of methyl ethyl ketone and toluene to obtain a sublayer. The solution was applied on the surface of the substrate using a wired bar coater followed by drying the coated solution under the heating air of 70° C. Thus resulted in obtained a substrate having a sublayer of a polyester resin having a thickness of 1 μm.

A vacuum chamber was temporarily exhausted, followed by introducing Ar gas to allow a vacuum degree to be $10\times10^{-2}$ Pa. While maintaining the surface temperature of the support at 100° C., deposition was conducted until the film thickness of the stimulable phosphor layer reached 200 μm to prepare a radiation image conversion panel sample.

Herein, in the deposition apparatus shown in FIG. 1, the vaporization source was arranged at the right angles to the normal line passing at the center of the support, wherein the distance $d_1$ between the support and the vaporization source was 60 $cm^{-1}$ Deposition was conducted as the support was rotated.

Subsequently, the stimulable phosphor layer was covered with a thin layer (film thickness: 2.0 am) of a tetrafluoroethylene-hexafluoropropylene copolymer which has been coated with a polyester resin having a thickness 1.0 μm as an adhesive agent. The thin layer of a tetrafluoroethylene-hexafluoropropylene copolymer serves as a protective layer for the stimulable phosphor layer. The covering was achieved using a laminator. Radiation Image Conversion Panel Sample 1 was thus obtained.

Samples 2-16 were prepared by changing the substrate as are shown in Table 1 and forming a phosphor layer on each substrate.

The thickness of sublayer was controlled by changing the size of wire of the wired bar coaters so as to obtained an intended thickness. Sample 2 was prepared without providing a sublayer and forming a phosphor layer on the substrate.

(Evaluation Methods)

The columns each having a curvature radius shown in Table 1 were employed to transport the prepared Radiation image conversion panels. After 1000 times of transportation of samples, the following properties were evaluated using criteria shown below.

A. Cracking

The evaluation is done by visually observing the surface of the Radiation image conversion panels.

1: Reading of the panel cannot be performed due to cracking appeared in almost all portion of the panel, or deformation of the substrate.

2: A large amount of cracking is observed and cracking can be detected from the obtained image.

3: A certain amount of cracking is observed but cracking cannot be detected from the obtained image.

4: A small amount of cracking is observed but cracking cannot be detected from the obtained image.

5: No cracking is observed.

B. Peeling

The evaluation is done by visually observing the surface of the Radiation image conversion panels.

1: Peeling takes place in every portion of the panel, and the phosphor layer is peeled off from the substrate.

2: A large amount of peeling is observed and peeling can be detected from the obtained image.

3: A certain amount of peeling is observed but peeling cannot be detected from the obtained image.

4: A small amount of peeling is observed but peeling cannot be detected from the obtained image.

5: No peeling is observed.

C. Nonuniformity of Image

The evaluation is done by observing an image obtained from REGIUS 190 (made by Konica Minolta Medical Graphic Inc.) using the panels irradiated with X rays having 80 kV and 60 mAS at a distance of 100 cm form the radiation source.

0: Cannot be read due to deformation of the plate and Cannot be used for detecting images.

1: A large amount of nonuniformity of image is observed and cannot be used for detecting images.

2: Nonuniformity of image is observed and it is hard to use for detecting images.

3: A small amount of nonuniformity of image is observed but it can be use for detecting images.

4: A slight amount of nonuniformity of image is observed but it can be use for detecting images.

5: Nonuniformity of image is not observed or almost not observed.

TABLE 1

| Panel | Substrate | | Sublayer | Curvature | Evaluation result | | | |
|---|---|---|---|---|---|---|---|---|
| Sample No. | Kind | Thickness (mm) | Thickness (mm) | radius (mm) | Cracking | Peeling | Nonuniformity of image | Remarks |
| 1 | PEN film | 0.5 | 1 | 60 | 4 | 4 | 5 | Inv. |
| 2 | PEN film | 0.5 | — | 60 | 3 | 3 | 5 | Inv. |
| 3 | PEN film | 0.5 | 8 | 60 | 5 | 4 | 4 | Inv. |
| 4 | PEN film | 0.5 | 12 | 60 | 4 | 4 | 3 | Inv. |
| 5 | PEN film | 2 | 1 | 60 | 4 | 4 | 5 | Inv. |
| 6 | PEN film | 6 | 1 | 60 | 4 | 4 | 3 | Inv. |
| 7 | PI film | 0.5 | 1 | 60 | 4 | 4 | 5 | Inv. |
| 8 | PI film | 0.5 | 1 | 90 | 5 | 4 | 5 | Inv. |
| 9 | PI film | 0.5 | 1 | 180 | 5 | 5 | 5 | Inv. |
| 10 | PI film | 0.5 | 1 | 45 | 2 | 2 | 2 | Comp. |
| 11 | PET film | 0.5 | 1 | 60 | 4 | 4 | 4 | Inv. |
| 12 | PES film | 0.5 | 1 | 60 | 4 | 4 | 4 | Inv. |
| 13 | Polyamide film | 0.5 | 1 | 60 | 4 | 4 | 4 | Inv. |
| 14 | Aramid film | 0.5 | 1 | 60 | 4 | 4 | 4 | Inv. |
| 15 | Glass | 1 | 1 | 60 | 1 | 1 | 0 | Comp. |
| 16 | Aluminium | 0.5 | 1 | 60 | 1 | 1 | 0 | Comp. |

Inv.: Inventive sample
Comp: Comparative sample
PEN: polyethylene naphthalate
PI: polyimide
PET: polyethylene terephthalate
PES: polyethylene sulfide Table 1 demonstrates that Radiation image conversion panels of the present invention are superior to Comparative samples from the viewpoint of cracking property, peeling property and uniformity of image.

What is claimed is:

1. A reading system for reading information recorded in a radiation image conversion panel comprising a flexible substrate made of an organic resin film and having thereon a phosphor layer comprising a columnar crystal phosphor, wherein the reading system has a transport section to transport the radiation image conversion panel with curvature when the radiation image conversion panel is transported in the reading system, provided that the radiation image conversion panel has a curvature radius of from 50 to 500 mm during transportation by the transport section in the reading system.

2. The reading system of claim 1, wherein the curvature radius of the radiation image conversion panel during transportation by the transport section in the reading system is from 55 to 200 mm.

3. The reading system of claim 1, wherein the organic resin is selected from the group consisting of polyethylene terephthalate, polyethylene naphthalate, polyethylene sulfide, polyimide, polyamide and aramid.

4. The reading system of claim 1, wherein the flexible substrate has a sublayer between the flexible substrate and the phosphor layer, the sublayer comprising an organic resin and having a thickness of 0.1 to 10 μm.

5. The reading system of claim 1, wherein the flexible substrate has a thickness of 0.5 to 5 mm.

6. The reading system of claim 1, wherein the columnar crystal phosphor is a stimulable phosphor.

7. The reading system of claim 6, wherein the stimulable phosphor comprises CsBr as a matrix component.

8. A method for reading information recorded in a radiation image conversion panel comprising:

providing a radiation image conversion panel with information recorded in the radiation image conversion panel, the panel comprising a flexible substrate made of an organic resin film and having thereon a phosphor layer comprising columnar crystal phosphor; and reading the information on the image conversion panel with a reading system, the reading system having a transport section to transport the radiation image conversion panel with curvature when the radiation image conversion panel is transported in the reading system, and that the radiation image conversion panel having a curvature radius of from 50 to 500 mm during transportation by the transport section in the reading system.

9. The method of claim 8 wherein the curvature radius of the radiation image conversion panel during transportation by the transport section in the reading system is from 55 to 200 mm.

10. The method of claim 8, wherein the organic resin is selected from the group consisting of polyethylene terephthalate, polyethylene naphthalate, polyethylene sulfide, polyimide, polyamide and aramid.

11. The method of claim 8, wherein the flexible substrate has a sublayer between the flexible substrate and the phosphor layer, the sublayer comprising an organic resin and having a thickness of 0.1 to 10 μm.

12. The method of claim 8, wherein the flexible substrate has a thickness of 0.5 to 5 mm.

13. The method of claim 8, wherein the columnar crystal phosphor is a stimulable phosphor.

14. The method of claim 13, wherein the stimulable phosphor comprises CsBr as a matrix component.

* * * * *